US007216968B2

(12) United States Patent
Smith et al.

(10) Patent No.: US 7,216,968 B2
(45) Date of Patent: May 15, 2007

(54) MEDIA ELECTROSTATIC HOLD DOWN AND CONDUCTIVE HEATING ASSEMBLY

(75) Inventors: David E. Smith, Vancouver, WA (US); Robert M. Yraceburu, Camas, WA (US); Stephen McNally, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 382 days.

(21) Appl. No.: 10/445,162

(22) Filed: May 24, 2003

(65) Prior Publication Data

US 2004/0233264 A1 Nov. 25, 2004

(51) Int. Cl.
*B41J 2/01* (2006.01)

(52) U.S. Cl. ..... 347/102; 347/104; 271/193

(58) Field of Classification Search ..... 347/102, 347/104; 271/193, 275, 195; 279/128; 219/774, 219/775, 777; 198/691; 361/234; 400/645; 399/316

See application file for complete search history.

(56) References Cited

U.S. PATENT DOCUMENTS

| | | | | |
|---|---|---|---|---|
| 2,576,882 | A | 11/1951 | Koole et al. | |
| 3,690,646 | A | 9/1972 | Kolibas | |
| 3,916,270 | A | 10/1975 | Watchtler et al. | |
| 4,207,579 | A | 6/1980 | Gamblin et al. | |
| 4,453,841 | A * | 6/1984 | Bobick et al. | 347/16 |
| 4,751,609 | A | 6/1988 | Kasahara | |
| 4,803,500 | A | 2/1989 | Milbrandt | |
| 4,821,049 | A | 4/1989 | Eckl | |
| 4,872,027 | A | 10/1989 | Buskirk et al. | |
| 4,982,027 | A | 1/1991 | Tunmore et al. | |
| 4,982,207 | A | 1/1991 | Tunmore et al. | |
| 5,041,718 | A | 8/1991 | D'Hondt et al. | |
| 5,094,613 | A | 3/1992 | Dolcimascolo et al. | |
| 5,173,834 | A | 12/1992 | Sogoh | |
| 5,216,442 | A | 6/1993 | Parks et al. | |
| 5,241,159 | A | 8/1993 | Chatteriee et al. | |
| 5,342,133 | A | 8/1994 | Canfield | |
| 5,345,863 | A | 9/1994 | Kurata et al. | |
| 5,369,424 | A | 11/1994 | Hori | |
| 5,419,644 | A | 5/1995 | Martin et al. | |
| 5,428,383 | A | 6/1995 | Shields et al. | |
| 5,461,482 | A | 10/1995 | Wilson et al. | |
| 5,570,118 | A | 10/1996 | Rezanka et al. | |
| 5,593,151 | A | 1/1997 | Mashtare et al. | |
| 5,593,240 | A | 1/1997 | Broder et al. | |

(Continued)

FOREIGN PATENT DOCUMENTS

| | | |
|---|---|---|
| EP | 0583016 | 9/1997 |

(Continued)

OTHER PUBLICATIONS

Alec J. Babiarz, "Developing a Low-Cost Electrostatic Chart-Hold Table" 2 pages.

*Primary Examiner*—Stephen Meier
*Assistant Examiner*—Ly T. Tran

(57) ABSTRACT

A media hold down and heating assembly of one embodiment of the invention is disclosed that includes a dielectric against which media is positioned, a conductive heating element, and an electrostatic hold down element. The conductive heating element is to conductively heat the media through the dielectric. The electrostatic hold down element is to electrostatically hold down the media against the dielectric.

39 Claims, 6 Drawing Sheets

U.S. PATENT DOCUMENTS

| | | | | |
|---|---|---|---|---|
| 5,668,584 | A | 9/1997 | Broder et al. | |
| 5,712,672 | A | 1/1998 | Gooray et al. | |
| 5,714,736 | A | 2/1998 | Yoneda et al. | |
| 5,737,178 | A * | 4/1998 | Herchen | 361/234 |
| 5,771,054 | A | 6/1998 | Dudek et al. | |
| 5,784,090 | A | 7/1998 | Selensky et al. | |
| 5,821,968 | A | 10/1998 | Ohyama et al. | |
| 5,886,866 | A * | 3/1999 | Hausmann | 361/234 |
| 5,896,154 | A | 4/1999 | Mitani et al. | |
| 6,120,143 | A | 9/2000 | Narushima et al. | |
| 6,152,444 | A | 11/2000 | Elgee et al. | |
| 6,168,269 | B1 | 1/2001 | Rasmussen et al. | |
| 6,215,643 | B1 | 4/2001 | Nagasaki | |
| 6,224,203 | B1 | 5/2001 | Wotton et al. | |
| 6,309,063 | B1 | 10/2001 | Kamano et al. | |
| 6,309,064 | B1 | 10/2001 | Tanno et al. | |
| 6,336,722 | B1 | 1/2002 | Wotton et al. | |
| 6,390,618 | B1 * | 5/2002 | Wotton et al. | 347/102 |
| 6,436,843 | B1 * | 8/2002 | Meinhold et al. | 438/758 |
| 6,454,478 | B2 | 9/2002 | Wotton et al. | |
| 6,467,410 | B1 | 10/2002 | Rasmussen et al. | |
| 6,508,540 | B1 | 1/2003 | Lean et al. | |
| 6,511,172 | B2 | 1/2003 | Tanno et al. | |
| 6,529,220 | B1 | 3/2003 | Matsumoto | |
| 6,588,580 | B2 | 7/2003 | Janzen | |
| 6,595,515 | B2 | 7/2003 | Numata et al. | |
| 2003/0016269 | A1 | 1/2003 | Sekiya | |

FOREIGN PATENT DOCUMENTS

| | | |
|---|---|---|
| EP | 1207045 | 5/2002 |
| JP | 03130158 | 6/1991 |
| JP | 10087102 | 4/1998 |
| JP | 2000143026 | 5/2000 |
| JP | 2000191175 | 7/2000 |
| JP | 2002302287 | 10/2002 |

* cited by examiner

MEDIA ELECTROSTATIC HOLD DOWN AND CONDUCTIVE HEATING ASSEMBLY

BACKGROUND

Inkjet printers have become popular for printing on media, especially when precise printing of color images is needed. For instance, such printers have become popular for printing color image files generated using digital cameras, for printing color copies of business presentations, and so on. An inkjet printer is more generically a fluid-ejection device that ejects fluid, such as ink, onto media, such as paper.

To maintain positioning of the media while fluid is being ejected onto the media, some fluid-ejection devices utilize various hold down elements to keep the media properly in place. Furthermore, to expedite drying of the fluid that has been ejected onto the media, some fluid-ejection devices utilize various heating elements. However, including both a hold down element and a heating element in the same fluid-ejection device can cause the two elements to interfere with one another, such that one or both of the elements may not function correctly or optimally.

SUMMARY OF THE INVENTION

A media hold down and heating assembly of one embodiment of the invention includes a dielectric against which media is positioned, a conductive heating element, and an electrostatic hold down element. The conductive heating element is to conductively heat the media through the dielectric. The electrostatic hold down element is to electrostatically hold down the media against the dielectric.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Media Electrostatic Hold Down and Conductive Heating Assembly

Figure 1:
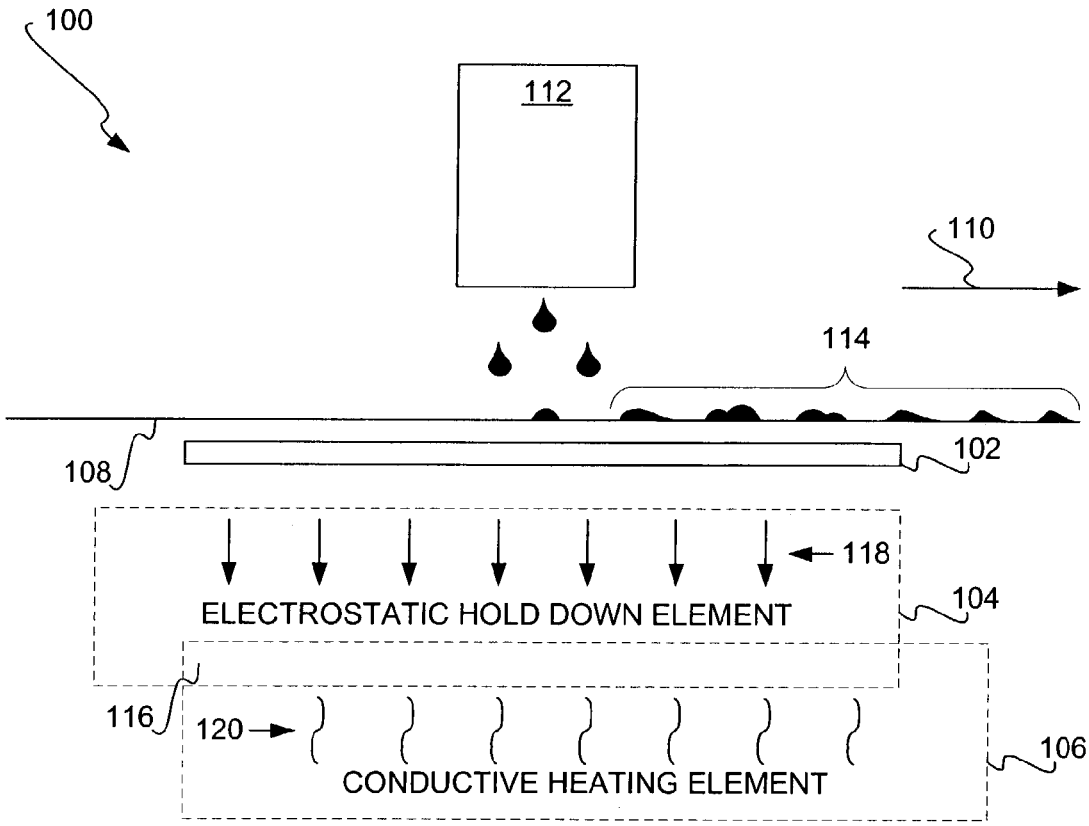
FIG. 1 is a diagram of a side view of a media hold down and heating assembly, according to an embodiment of the invention.

FIG. 1 shows a side view of a media hold down and heating assembly 100, according to an embodiment of the invention. The assembly 100 is specifically depicted in FIG. 1 in which a fluid-ejection mechanism 112, such as an inkjet printhead, ejects fluid 114, such as ink, onto media 108. The media 108 in this case may be paper, transparencies, cardboard, or another type of media that is amenable to receiving fluid ejection. However, in other embodiments of the invention, the assembly 100 can be utilized in conjunction with other types of media in which the fluid-ejection mechanism 112 is not present. For instance, the assembly 100 may be utilized in conjunction with media that is a semiconductor wafer, for utilization in semiconductor processing.

The media hold down and heating assembly 100 includes a dielectric 102, an electrostatic hold down element 104 and a conductive heating element 106. The dielectric 102 may be a polymer or plastic strip or sheet, or another type of dielectric. Preferably but not necessarily, the dielectric 102 is solid, without any perforations or holes. The electrostatic hold down element 104 and the conductive heating element 106 may share some components, as indicated by the overlapping region 116 between the elements 104 and 106. Furthermore, some of the components of the element 104 and/or 106 may be at least partially embedded or situated within the dielectric 102, which is not specifically depicted in FIG. 1.

The electrostatic hold down element 104 generates an electric field that attracts, or holds down, the media 108 against the dielectric 102, as indicated by the arrows 118. As such, it is preferably a capacitive hold down element. The element 104 performs this electrostatic hold down functionality so that the media 108 is properly positioned against the dielectric 102 for the fluid-ejection mechanism 112 to eject the fluid 114 on the media 108. The conductive heating element 106 generates heat, as indicated by the squiggly lines 120, that conducts through the dielectric 102 and to the media 108 and the fluid 114 that has been ejected onto the media 108. The element 106 performs this conductive heating functionality to dry or expedite drying of the fluid 114 that has been ejected onto the media 108.

Figure 2:
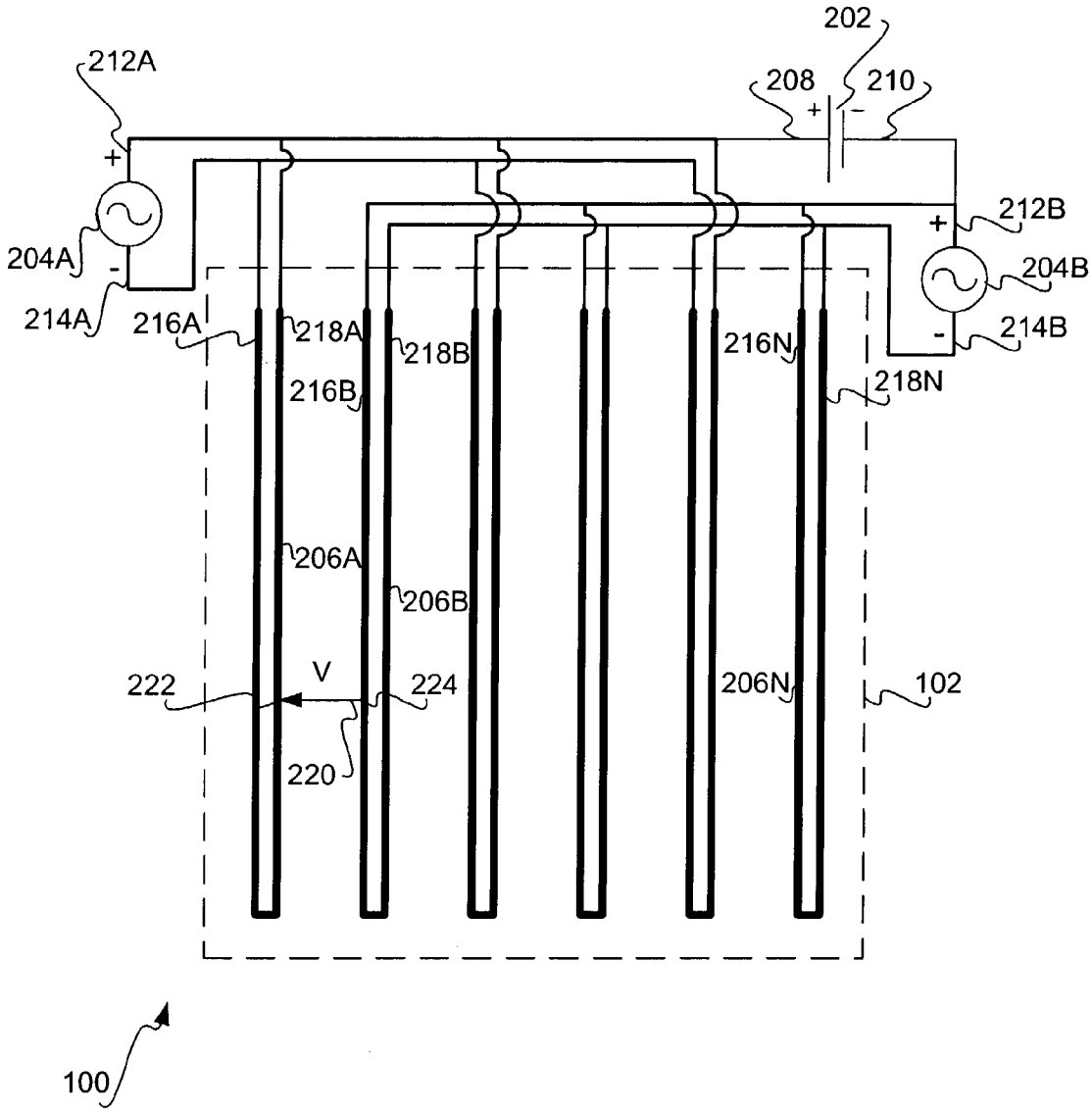
FIG. 2 is a diagram of a cross-sectional top view of a media hold down and heating assembly, according to an embodiment of the invention.

FIG. 2 shows a top view of the media hold down and heating assembly 100 in detail, according to an embodiment of the invention. The electrostatic hold down element 104 of FIG. 1 is inclusive of a high-voltage source 202 and a number of electrodes 206A, 206B, . . . , 206N, which are collectively referred to as the electrodes 206. The electrodes 206 may also be referred to as resistive elements without loss of generality. The conductive heating element 106 of FIG. 1 is inclusive of a pair of electric heater power supplies 204A and 204B, which are collectively referred to as the electric heater power supplies 204, as well as the electrodes 206. The elements 104 and 106 thus share the electrodes 206 between themselves. The dielectric 102 is indicated as a dotted line, to indicate the cross-sectional nature of FIG. 2, such that the electrodes 206 are situated under at least the top surface of the dielectric 102, on which the media 108 is positioned in FIG. 1.

The high-voltage source 202 has a positive terminal 208 and a negative terminal 210. The electric heater power supply 204A has a positive terminal 212A and a negative terminal 214A, whereas the electric heater power supply 204B has a positive terminal 212B and a negative terminal 214B. Each of the electrodes 206 is preferably substantially shaped as an elongated U having two ends. For instance, the electrode 206A has a first end 216A and a second end 218A, the electrode 206B has a first end 216B and a second end 218B, and the electrode 206N has a first end 216N and a second end 218N. Although there are six of the electrodes 206 in FIG. 2, this is provided as an illustrative example, and other embodiments may have more or less of the electrodes 206. The electrodes 206 are situated or positioned parallel to one another on their long sides.

The electrodes 206 may be logically numerated from the first electrode 206A to the last electrode 206N, such that the electrodes 206 include both odd-numbered and even-numbered electrodes. The positive terminal 212A of the first electric heater power supply 204A is connected to the positive terminal 208 of the high-voltage source 202 and to the second ends 218 of odd-numbered of the electrodes 206, whereas the negative terminal 214A of the first electric heater power supply 204A is connected to the first ends 216 of the odd-numbered of the electrodes 206. The positive terminal 212B of the second electric heater power supply 204B is connected to the negative terminal 210 of the high-voltage source 202 and to the first ends 216 of even-numbered of the electrodes 206, whereas the negative terminal 214B of the second electric heater power supply 204B is connected to the second ends 218 of the even-numbered of the electrodes 206. The import of this spatial positioning of the electrodes 206, the electric heater power supplies 204, and the high-voltage source 202 of this embodiment of the invention is described in the next section of the detailed description.

The high-voltage source 202 creates an electric field between adjacent electrodes 206. This is the electric field that electrostatically attracts the media 108 against the dielectric 102 in FIG. 1. The electric heater power supplies 204 cause the electrodes 206 to generate heat. This is the heat that conducts through the dielectric 102 to the media 108 and the fluid 114 ejected thereon in FIG. 1. Also depicted in FIG. 2 is a voltage 220 between a point 222 of the electrode 206A and a point 224 of the electrode 206B, as is specifically described in the next section of the detailed description.

Figure 3A:
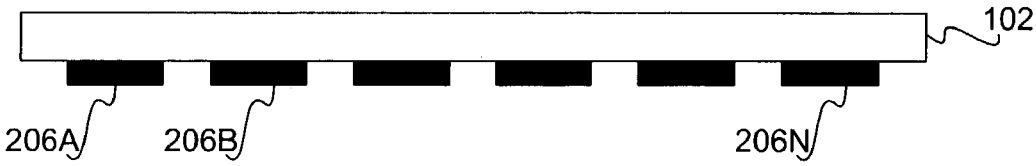
FIGS. 3A and 3B are diagrams of side views depicting how electrodes of a media hold down and heating assembly can be situated within a dielectric of the assembly, according to varying embodiments of the invention.
Figure 3B:
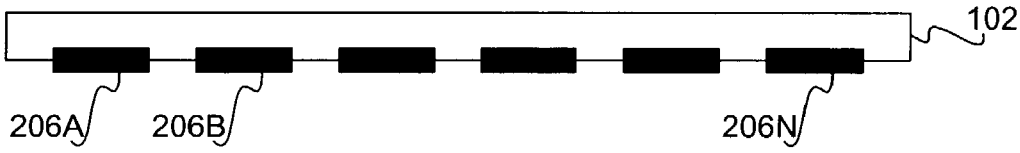

FIGS. 3A and 3B show side views of different manners by which the electrodes 206 may be situated or positioned relative to the dielectric 102, according to varying embodiments of the invention. In FIG. 3A, the electrodes 206 are situated or positioned under the dielectric 102. The electrodes 206 may or may not make actual contact with the dielectric 102. In FIG. 3B, the electrodes 206 are partially situated, positioned, or disposed within the dielectric 102. The electrodes 206 may also be completely disposed within the dielectric 102.

Figure 4A:
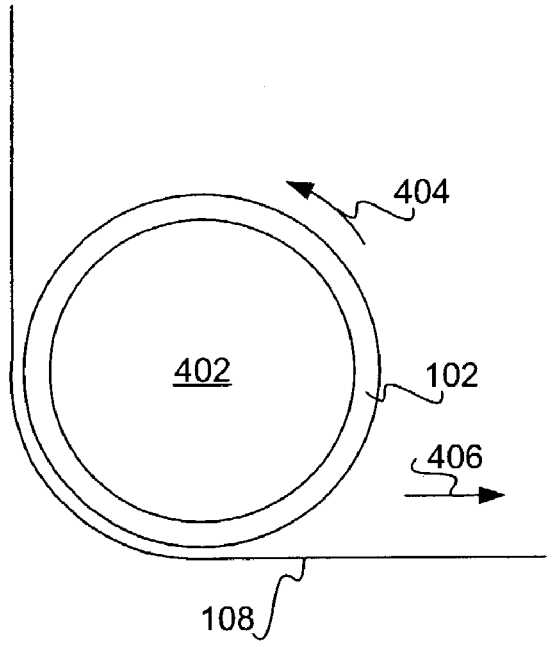
FIGS. 4A and 4B are diagrams depicting how a dielectric of a media hold down and heating assembly can be implemented as or within a drum and a belt, respectively, according to varying embodiments of the invention.
Figure 4B:
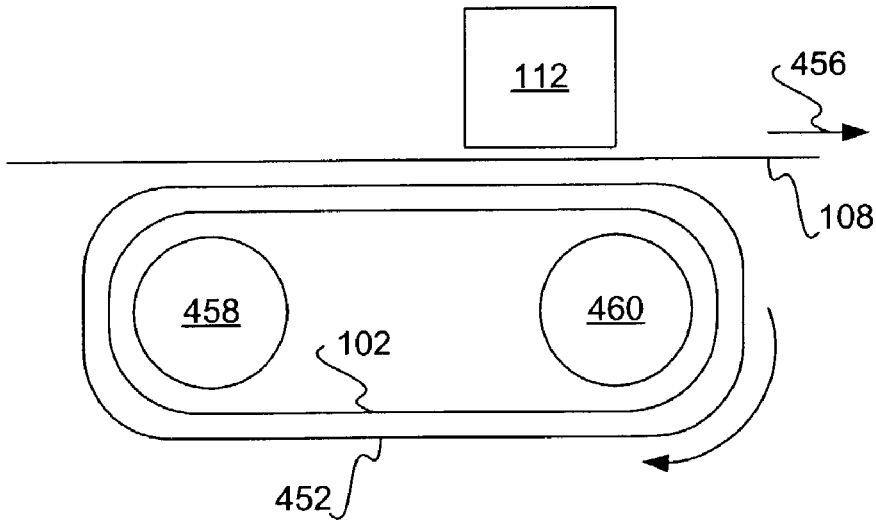

FIGS. 4A and 4B show how the dielectric 102 may be implemented, according to varying embodiments of the invention. In the side view of FIG. 4A the dielectric 102 is part of or includes a drum 402 that rotates counter-clockwise, as indicated by the arrow 404. The media 108 moves around the drum 402 as is depicted in FIG. 4A, ultimately moving in the direction indicated by the arrow 406. In the side view of FIG. 4B, the dielectric 102 is part of or includes a belt 452 that moves clockwise, as indicated by the arrow 460, around the pulleys 458 and 460. The belt 460 moves the media 108 from left to right, as indicated by the arrow 456 (consistent with the arrow 110 of FIG. 1), under the fluid-ejection mechanism 112, which may be stationary, or move in and out of the plane of FIG. 4B. By comparison to FIGS. 4A and 4B, the previously described FIG. 1 can be considered in one embodiment to depict the dielectric 102 as part of or included in a platen.

Non-Interference Between Hold Down Element and Heating Element

In at least some embodiments of the invention, the electrostatic hold down element 104 and the conductive heating element 106 of the media hold down and heating assembly 100 of FIG. 1 do not affect one another. For instance, the electric field generated by the electrostatic hold down element 104 is not affected by the conductive heating element 106, such that the elements 104 and 106 do not interfere with one another in the functionalities that they perform. More specifically, the electrodes 206, the electric heater power supplies 204, and the high-voltage source 202 of FIG. 2 are spatially positioned such that the electric field created by the high-voltage source 202 within the electrodes 206 is unaffected by the electric heater power supplies 204.

Such non-interference between the high-voltage source 202 and the electric heater power supplies 204 of FIG. 2 is demonstrated in one specific embodiment by the voltage between each adjacent pair of electrodes 206, such as the voltage 220 of FIG. 2 between the points 222 and 224, being equal to the voltage of the high-voltage source 202. Because the voltage between each adjacent pair of electrodes 206 is equal to the voltage of the high-voltage source 202, the electric heater power supplies 204 do not affect the high-voltage source 202 and thus do not affect the electric field created by the high-voltage source 202 within the electrodes 206. This is now particularly described in relation to the voltage 220 being equal to the voltage of the high-voltage source 202.

The hold down force is caused by an electric field between adjacent electrodes 206, such as the electrodes 206A and 206B. The electric field is generated by the voltage difference between the electrodes 206A and 206B, also referred to as the voltage 220. Where the resistance of the electrodes 206 is equal, the resistance from the second end 218A to the point 222 of the electrode 206A, referred to as $R_{be}$, is identical to the resistance from the first end 216B to the point 224 of the electrode 206B, referred to as $R_{cf}$. Likewise, the resistance from the first end 216A to the point 222 of the electrode 206A, referred to as $R_{ae}$, is identical to the resistance from the second end 218B to the point 224 of the electrode 206B, referred to as $R_{df}$.

The voltage between the points 222 and 224 is then given by:

$$V_{ef}=V_{eb}+HV+V_{cf}, \quad (1)$$

where $V_{ef}$ is the voltage 220, $V_{eb}$ is the voltage from the point 222 to the second end 218 of the first electrode 206A, HV is the voltage of the high-voltage source 202, and the voltage $V_{cf}$ is the voltage from the point 224 to the first end 216B of the second electrode 206B. Since $$V_{eb} = -\frac{V_{ht1}R_{be}}{R_{be}+R_{ae}}, \tag{2}$$

where $V_{ht1}$ is the voltage of the first electric heater power supply 204A, and since $$V_{cf} = \frac{V_{ht2}R_{cf}}{R_{cf}+R_{df}}, \tag{3}$$

where $V_{ht2}$ is the voltage of the second electric heater power supply 204B, then $$V_{ef} = -\frac{V_{ht1}R_{be}}{R_{be}+R_{ae}} + HV + \frac{V_{ht2}R_{cf}}{R_{cf}+R_{df}}. \tag{4}$$

Further, since $R_{cf}$ equals $R_{be}$ and $R_{df}$ equals $R_{ae}$, then $$V_{ef} = -\frac{V_{ht1}R_{be}}{R_{be}+R_{ae}} + HV + \frac{V_{ht2}R_{be}}{R_{be}+R_{ae}}, \tag{5}$$

or, $$V_{ef} = \frac{(V_{ht2}-V_{ht1})R_{be}}{R_{be}+R_{ae}} + HV. \tag{6}$$

Thus, if $V_{ht1}$ equals $V_{ht2}$, then $$V_{ef}=HV. \tag{7}$$

Therefore, if the voltage of the first electric heater power supply 204A is equal to the voltage of the second electric heater power supply 204B, then the voltage 220, which is representative of the voltage between each adjacent pair of the electrodes 206, is equal to the voltage of the high-voltage source 202. This means that the electric heater power supplies 204 do not affect or interfere with the electric field created by the high-voltage source 202 within the electrodes 206. The voltages of the electric heater power supplies 204 are equal to one another in one embodiment where the electric heater power supplies 204 are themselves identical.

It is noted that the differences in the magnitudes of the voltages of the electric heater power supplies 204, and the differences in the resistances of the heating elements, can result in the heater power supplies 204 affecting the electric field holding down the media. There is substantially no interference between the heater power supplies 204 and the high-voltage source 202 on the electric field holding down the media where the resistances of the power supplies 204 are substantially equal.

Fluid-Ejection Device and Methods

Figure 5:
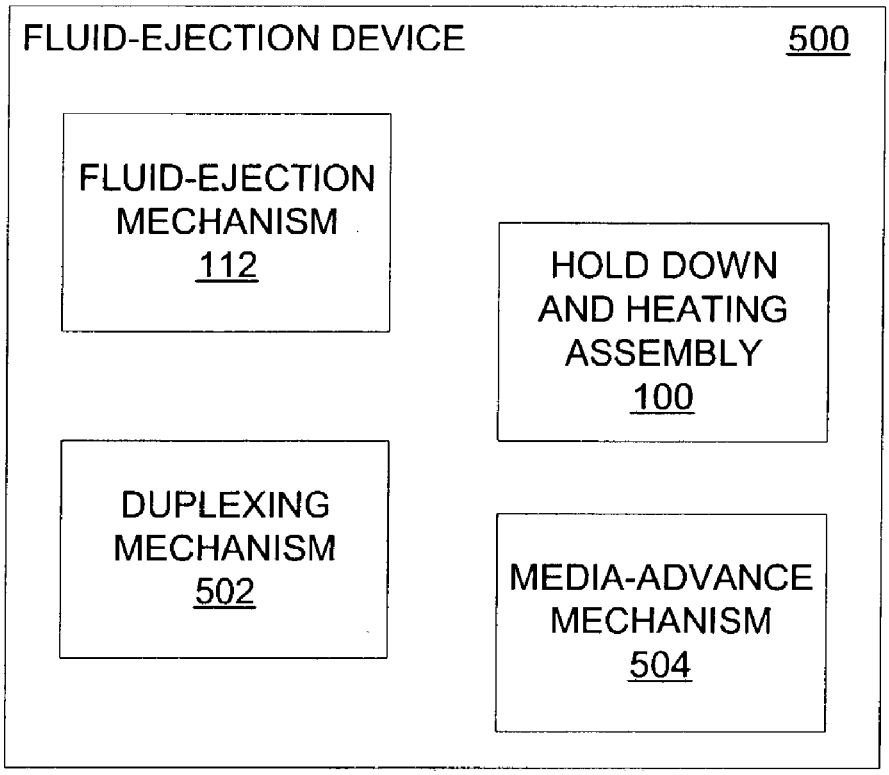
FIG. 5 is a block diagram of a fluid-ejection device, according to an embodiment of the invention.

FIG. 5 shows a block diagram of a fluid-ejection device 500, according to an embodiment of the invention. The fluid-ejection device 500 includes the fluid-ejection mechanism 112 and the hold down and heating assembly 100 that have been described. The fluid-ejection device 500 also optionally includes a duplexing mechanism 502 and/or a media-advance mechanism 504. The fluid-ejection device 500 may include other components in addition to or in lieu of those depicted in FIG. 5, as can be appreciated by those of ordinary skill within the art.

The fluid-ejection mechanism 112 ejects fluid onto the media 108 of FIG. 1. Where the fluid is ink, the fluid-ejection mechanism 112 is an inkjet-printing mechanism, such as an inkjet printhead, and the fluid-ejection device 500 is an inkjet-printing device, such as an inkjet printer or another device that includes inkjet-printing functionality. The hold down and heating assembly 100 is an electrostatic hold down and conductive heating assembly, and may be implemented in one embodiment as has been described in the preceding sections of the detailed description. Thus, the assembly 100 electrostatically holds down the media 108 for the fluid-ejection mechanism 112 to eject fluid onto the media 108, and conductively heats the media 108 to substantially dry the fluid ejected onto the media 108.

The duplexing mechanism 502 is a mechanism that allows the fluid-ejection mechanism 112 to eject fluid onto both sides of the media 108 of FIG. 1 without manual reinsertion of the media 108 into the fluid-ejection device 500 by a user, after one side of the media 108 has had fluid ejected onto it. For instance, the fluid-ejection mechanism 112 may eject fluid over the media swaths of one side of the media 108. The duplexing mechanism 502 then effectively flips over the media 108, so that the fluid-ejection mechanism 112 may eject fluid over the media swaths of the other side of the media 108, as can be appreciated by those of ordinary skill within the art.

The media-advance mechanism 504 is a mechanism that advances the media 108 of FIG. 1 past and between the fluid-ejection mechanism 112 and the media hold down and heating assembly 100 in one embodiment of the invention. For instance, the media-advance mechanism 504 may advance the media so that a current swath of the media 108 lies between the mechanism 112 and 100. The fluid-ejection mechanism 112 ejects fluid onto this media swath while the media hold down and heating assembly 100 electrostatically holds down the media 108. The media hold down and heating assembly 100 then conductively heats the media 108 to substantially dry the fluid ejected onto the media swath. The media-advance mechanism 504 advances the media 108 to a next media swath on which fluid is to be ejected, and this process continues until the media 108 has had fluid ejected thereon as intended.

Figure 6:
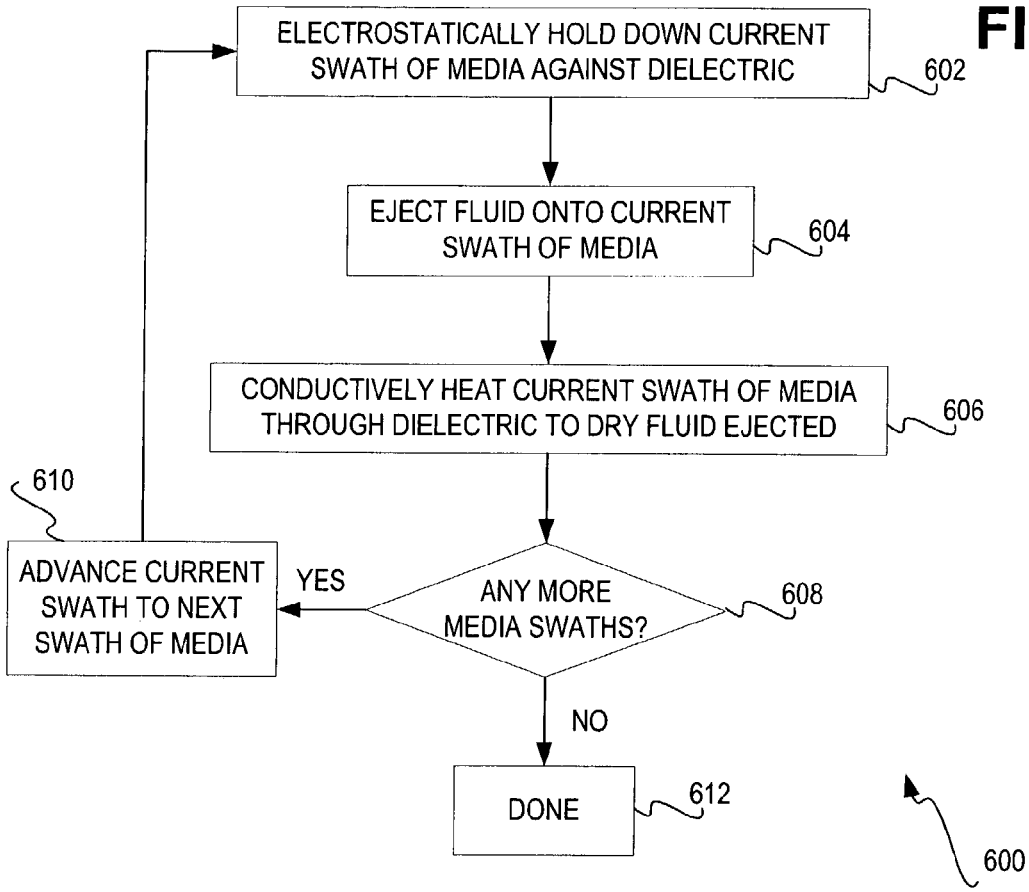
FIG. 6 is a flowchart of a method of use, according to an embodiment of the invention.

FIG. 6 shows a method of use 600, according to an embodiment of the invention. The method 600 may be performed by the fluid-ejection device 500 of FIG. 5, and/or the media hold down and heating assembly 100 of FIG. 1. A current swath of the media 108 is electrostatically held down against the dielectric 102 of FIG. 1 (602). While the current swath of the media 108 of FIG. 1 is held down, the fluid 114 of FIG. 1 is ejected onto the current swath (604), and the current swath of the media 108 is conductively heated through the dielectric 102 to at least substantially dry the fluid 114 ejected (606). If there are any more swaths on the media 108 (608), then the current swath is advanced to the next swath of the media 108 (610), and the method 600 repeats at 602. Otherwise, the method 600 is finished (612).

Figure 7:
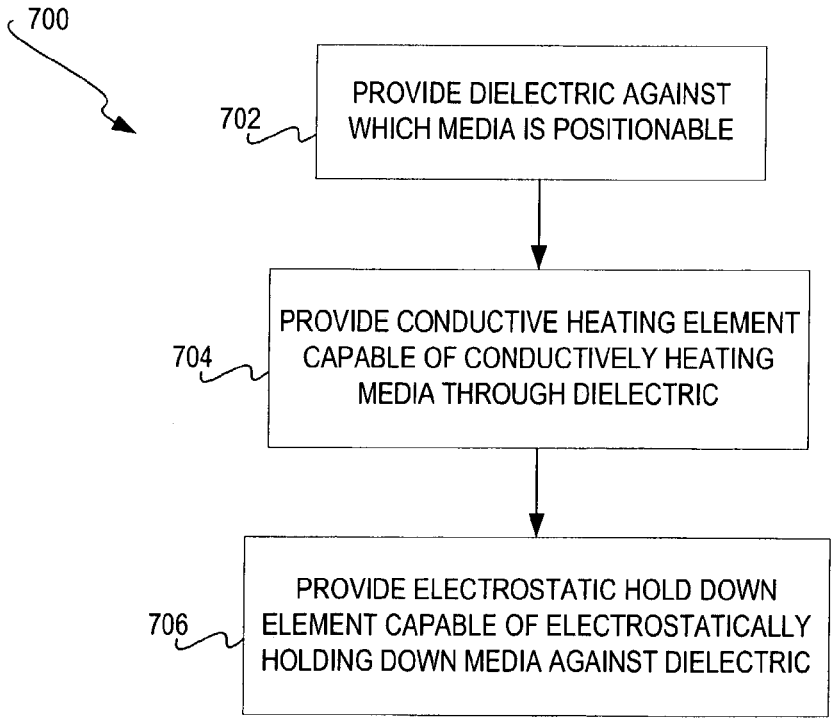
FIG. 7 is a flowchart of a method of manufacture, according to an embodiment of the invention.

FIG. 7 shows a method of manufacture 700, according to an embodiment of the invention. The method 700 may be performed to at least partially manufacture the media hold down and heating assembly 100 of FIG. 1, and/or the fluid-ejection device of FIG. 5. The dielectric 102 of FIG. 1 is provided, against which the media 108 of FIG. 1 is positionable (702). The conductive heating element 106 of FIG. 1 is also provided, which is capable of conductively heating the media 108 through the dielectric 102 (704). Finally, the electrostatic hold down element 104 of FIG. 1 is provided, which is capable of electrostatically holding down the media 108 against the dielectric 102 (706).

CONCLUSION

It is noted that, although specific embodiments have been illustrated and described herein, it will be appreciated by those of ordinary skill in the art that any arrangement calculated to achieve the same purpose may be substituted for the specific embodiments shown. This application is intended to cover any adaptations or variations of embodiments of the present invention. Therefore, it is manifestly intended that this invention be limited only by the claims and equivalents thereof.

We claim:

1. A media hold down and heating system comprising:

a dielectric against which paper-type media on which images are capable of being formed via fluid ejection is positioned, the dielectric comprising at least one of a belt and an at least substantially flat platen;

a conductive heating element to conductively heat the media through the dielectric;

an electrostatic hold down element to electrostatically hold down the media against the dielectric while the images are being formed on the media via fluid ejection; and, a plurality of electrodes shared by the conductive heating element to conductively heat the media and the electrostatic hold down element to electrostatically hold down the media.

2. The system of claim 1, wherein the conductive heating element comprises a plurality of electric heater power supplies.

3. The system of claim 1, wherein the electrostatic hold down element comprises a high-voltage source.

4. The system of claim 1, wherein the electrostatic hold down element is capacitive.

5. The system of claim 1, wherein the conductive heating element directly heats the electrodes to conductively heat the media through the dielectric, and the electrostatic hold down element creates an electric field between the electrodes that electrostatically attracts the media against the dielectric.

6. The system of claim 1, wherein the plurality of electrodes are situated to an opposite side of the dielectric to that which the media is positioned against.

7. The system of claim 1, wherein the plurality of electrodes are disposed at least partially within the dielectric.

8. A media hold down and heating system comprising:

a dielectric having a side against which paper-type media is positioned, the media capable of having images formed thereon via fluid ejection;

a plurality of electrodes at least partially situated to an opposite side of the dielectric;

a plurality of electric heater power supplies to heat the plurality of electrodes and to conductively heat the media through the dielectric; and, a high-voltage source to create an electric field between the plurality of electrodes to electrostatically hold down the media against the dielectric while the images are being formed on the media via fluid ejection, such that the electrodes are shared by both the electric heater power supplies to conductively heat the media and the high-voltage source to electrostatically hold down the media.

9. The system of claim 8, wherein the plurality of electrodes are completely situated to the opposite side of the dielectric.

10. The system of claim 8, wherein the plurality of electrodes are at least partially disposed within the dielectric.

11. The system of claim 8, wherein the plurality of electrodes, the plurality of electric heater power supplies, and the high-voltage source are spatially positioned relative to one another such that the electric field created by the high-voltage source is substantially unaffected by the plurality of electric heater power supplies.

12. The system of claim 8, wherein the plurality of electrodes are substantially elongated U-shaped electrodes positioned parallel to one another and logically numerative from a first electrode to a last electrode, each electrode having a first end and a second end.

13. The system of claim 12, wherein the plurality of electric heater power supplies comprises a first electric heater power supply and a second electric heater power supply, each having a positive terminal and a negative terminal, the high-voltage source also having a positive terminal and a negative terminal.

14. The system of claim 13, wherein the first electric heater power supply is connected to the positive terminal of the high-voltage source and to each odd-numbered electrode, and the second electric heater power supply is connected to the negative terminal of the high-voltage source and to each even-numbered electrode.

15. The system of claim 13, wherein the positive terminal of the first electric heater power supply is connected to the positive terminal of the high-voltage source and to the second end of each odd-numbered electrode, and the negative terminal of the first electric heater power supply is connected to the first end of each odd-numbered electrode.

16. The system of claim 15, wherein the positive terminal of the second electric heater power supply is connected to the negative terminal of the high-voltage source and to the first end of each even-numbered electrode, and the negative terminal of the second electric heater power supply is connected to the second end of each even-numbered electrode.

17. A media hold down and heating system comprising:

a dielectric having a side against which media is positioned;

a plurality of electrodes at least partially situated to an opposite side of the dielectric;

a plurality of electric heater power supplies to heat the plurality of electrodes and to conductively heat the media through the dielectric; and, a high-voltage source to create an electric field between the plurality of electrodes to electrostatically hold down the media against the dielectric, wherein the plurality of electrodes, the plurality of electric heater power supplies, and the high-voltage source are spatially positioned relative to one another such that a voltage between each successive pair of the plurality of electrodes is substantially equal to a voltage of the high-voltage source.

18. A media hold down and heating system comprising:

a dielectric against which paper-type media is positioned, the media capable of having images formed thereon via fluid ejection, the dielectric comprising one of a belt and, an at least substantially flat platen;

means for conductively heating the media through the dielectric and for electrostatically holding down the media against the dielectric while the images are formed on the media via fluid ejection; and a plurality of electrodes used by the means to both conductively heat the media and electrostatically hold down the media.

19. The system of claim 18, wherein the means is further for conductively heating the media and for electrostatically holding down the media such that electrostatically holding down the media is unaffected by conductively heating the media.

20. A fluid-ejection system comprising:

a fluid-ejection mechanism to eject fluid onto media;

a hold down and heating system to electrostatically hold down the media for the fluid-ejection mechanism to eject the fluid onto the media, and to conductively heat the media to substantially dry the fluid ejected onto the media, the hold down and heating system comprising a dielectric against which the media is positioned, the dielectric comprising one of a belt and an at least substantially flat platen; and, a plurality of electrodes used by the system to both conductively heat the media and electrostatically hold down the media.

21. The system of claim 20, further comprising a duplexing mechanism so that the fluid-ejection mechanism is able to eject fluid onto both sides of the media without manual reinsertion of the media into the fluid-ejection device.

22. The system of claim 20, further comprising a media-advance mechanism to advance the media past the fluid-ejection mechanism.

23. The system of claim 20, wherein the fluid-ejection mechanism is an inkjet-printing mechanism, such that the fluid-ejection device is an inkjet-printing device.

24. The system of claim 20, wherein the hold down and heating assembly further comprises:

a conductive heating element to conductively heat the media through the dielectric so that the fluid ejected onto the media is substantially dried; and, an electrostatic hold down element to electrostatically hold down the media against the dielectric for the fluid-ejection mechanism to eject fluid onto the media, wherein both the conductive heating element and the electrostatic hold down element share the electrodes to conductively heat the media and to electrostatically hold down the media.

25. A fluid-ejection system comprising:

a fluid-ejection mechanism to eject fluid onto media; and, a hold down and heating assembly to electrostatically hold down the media for the fluid-ejection mechanism to eject the fluid onto the media, and to conductively heat the media to substantially dry the fluid ejected onto the media, wherein the hold down and heating system comprises:

a dielectric having a side against which media is positioned;

a plurality of electrodes at least partially situated to an opposite side of the dielectric;

a plurality of electric heater power supplies to heat the plurality of electrodes and to conductively heat the media through the dielectric so that the fluid ejected onto the media is substantially dried; and, a high-voltage source to create an electric field between the plurality of electrodes to electrostatically hold down the media against the dielectric for the fluid-ejection mechanism to eject fluid onto the media, such that the electrodes are shared by both the electric heater power supplies to conductively heat the media and the high-voltage source to electrostatically hold down the media.

26. The system of claim 25, wherein the plurality of electrodes, the plurality of electric heater power supplies, and the high-voltage source are spatially positioned relative to one another such that the electric field created by the high-voltage source is unaffected by the plurality of electric heater power supplies.

27. A fluid-ejection system comprising:

a dielectric against which media is positioned, the dielectric comprising one of a belt and an at least substantially flat platen;

a fluid-ejection mechanism to eject fluid onto the media;

means for electrostatically holding down the media against the dielectric and for conductively heating the media to dry the fluid ejected onto the media such that electrostatically holding down the media is unaffected by conductively heating the media; and, a plurality of electrodes used by the means to both conductively heat the media and electrostatically hold down the media.

28. The system of claim 27, further comprising a duplexing mechanism so that the fluid-ejection mechanism is able to eject fluid onto both sides of the media without manual reinsertion of the media into the fluid-ejection device.

29. The system of claim 27, wherein the fluid-ejection mechanism ejects ink onto media, such that the fluid-ejection system is an inkjet-printing device.

30. The system of claim 27, wherein the means for electrostatically holding down the media and for conductively heating the media creates an electric field to electrostatically hold down the media, and conductively heats the media without affecting the electric field.

31. A method comprising:

electrostatically holding down a current swath of media against a dielectric using a plurality of electrodes, the dielectric comprising one of a belt and an at least substantially flat platen;

ejecting fluid onto the current swath of the media; and, conductively heating the current swath of the media through the dielectric to dry the fluid ejected, using the plurality of electrodes, such that the electrodes are used to both electrostatically hold down the media and conductively heat the media.

32. The method of claim 31, further initially comprising advancing the media so that the current swath thereof is positioned against the dielectric.

33. The method of claim 31, further comprising:

advancing the media so that a next swath of the media is the current swath of the media; and, repeating electrostatically holding down the current swath of the media, ejecting fluid onto the current swath of the media, and conductively heating the current swath of the media.

34. The method of claim 31, wherein ejecting fluid onto the current swath of the media comprises ejecting ink onto the current swath of the media.

35. The method of claim 31, wherein conductively heating the current swath of the media does not affect electrostatically holding down the current swath of the media.

36. A method comprising:

providing a dielectric against which media on which images are capable of being formed via fluid ejection is positionable, the dielectric comprising one of a belt and an at least substantially flat platen;

providing a conductive heating element capable of conductively heating the media through the dielectric;

providing an electrostatic hold down element capable of electrostatically holding down the media against the dielectric while the images are formed on the media via fluid ejection; and, providing a plurality of electrodes shared by both the conductive heating element to conductively heat the media and the electrostatic hold down element to electrostatically hold down the media.

37. The method of claim 36, wherein providing the dielectric comprises providing one of a belt and a platen.

38. The method of claim 36, wherein providing the conductive heating element comprises providing a plurality of electric heater power supplies.

39. The method of claim 36, wherein providing the electrostatic hold down element comprises providing a high-voltage source.

* * * * *